US005138720A

United States Patent [19]

Campbell

[11] Patent Number: 5,138,720

[45] Date of Patent: Aug. 18, 1992

[54] BRIDAL VEIL AND TIARA HEADBAND

[75] Inventor: Shirley L. Campbell, Granger, Iowa

[73] Assignee: Jamie Campbell, Des Moines, Iowa

[21] Appl. No.: 749,318

[22] Filed: Aug. 23, 1991

[51] Int. Cl.[5] ..... A42B 5/00

[52] U.S. Cl. ..... 2/207; 132/61

[58] Field of Search ..... 2/171, 181.2, 198, 207; 132/57.1, 60, 61

[56] References Cited

U.S. PATENT DOCUMENTS

| | | | |
|---|---|---|---|
| 500,962 | 7/1893 | Shepard | 132/61 |
| 534,989 | 3/1895 | Astrich | 132/61 |
| 852,125 | 4/1907 | Levison | 132/61 |
| 895,500 | 8/1908 | Scanlan | 132/61 |
| 1,011,394 | 12/1911 | Wilson | 132/61 |
| 2,157,835 | 5/1939 | Solomons | 132/61 |
| 2,255,611 | 9/1941 | Brown | 132/61 |
| 4,604,760 | 8/1986 | Coin | 2/207 |

*Primary Examiner*—Werner H. Schroeder
*Assistant Examiner*—Diana L. Biefeld
*Attorney, Agent, or Firm*—Zarley, McKee, Thomte, Voorhees, & Sease

[57] ABSTRACT

The headband of the present invention is useful for bridal veils, tiaras, and other head pieces. The headband includes a plurality of securement loops adapted to receive a bobby pin or bobby pin for securing the headband to a person's hair. The loops are provided on the front and lateral sides of the headband so as to be concealed from view, and so as to stabilize and prevent movement of the head piece.

20 Claims, 1 Drawing Sheet

BRIDAL VEIL AND TIARA HEADBAND

BACKGROUND OF THE INVENTION

Bridal veils worn by brides in weddings normally are held in place on the bride's head with a comb which is attached to the headband of the veil. However, the veil often times moves out of its intended position on the head since the teeth of the comb do not secure the veil against movement in all directions. Such instability of the veil requires inconvenient readjustments of the veil during the time that it is worn. Tiaras have similar problems with stability and repositioning.

Accordingly, a primary objective of the present invention is the provision of an improved headband for a bridal veil or a tiara which will keep the veil or tiara in the desired position on the person's head.

Another objective of the present invention is the provision of a headband for a bridal veil which is quick and easy to position on the bride's head.

Yet another objective of the present invention is the provision of a headband for a bridal veil or tiara which includes a plurality of loops for receiving bobby pins to hold the headband in place on the wearer's head.

Another objective of the present invention is the provision of a headband for bridal veils and tiaras which is economical to manufacture and safe and durable in use.

These and other objectives will become apparent from the following description of the invention.

SUMMARY OF THE INVENTION

The headband of the present invention can be used with a bridal veil, a tiara, or other head pieces, such as Catholic confirmation veils. The headband has interior and exterior sides and opposite top and bottom edges. A plurality of loops are attached to the interior side of the headband adjacent the bottom edge thereof so as to be hidden from view when the headband is worn. Each loop is adapted to receive a bobby pin for securing the headband, and thus the veil or tiara, to the wearer's hair. Preferably, the loops are provided along the front portion and opposite sides of the headband so as to prevent movement of the veil in any direction.

DETAILED DESCRIPTION OF THE DRAWINGS

Figure 1:
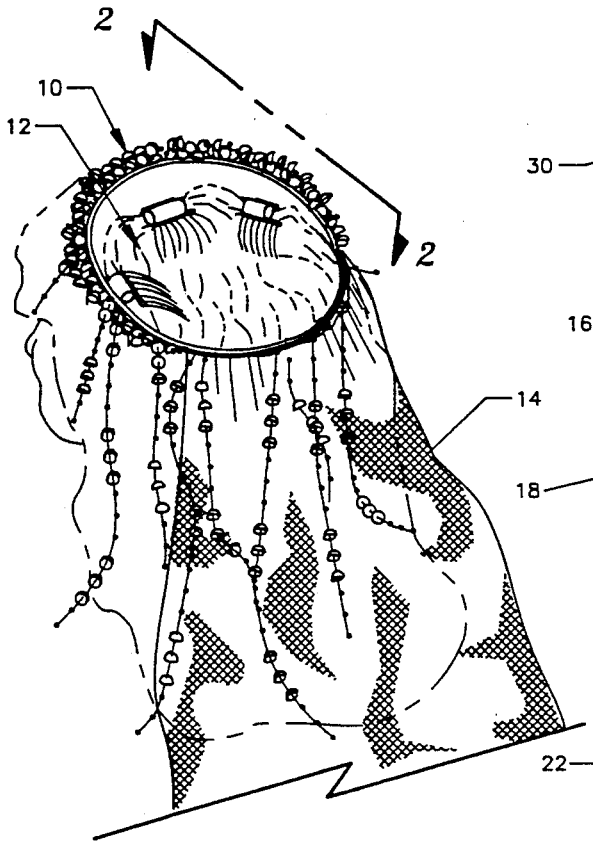
FIG. 1 is a perspective view of a bridal veil having a headband according to the present invention as positioned on a bride's head.

A bridal veil is generally designated by the reference numeral 10 in the drawings. The veil 10 is worn on a bride's head 12, and includes conventional netting 14 or other decorative ornamentation.

Figure 4:
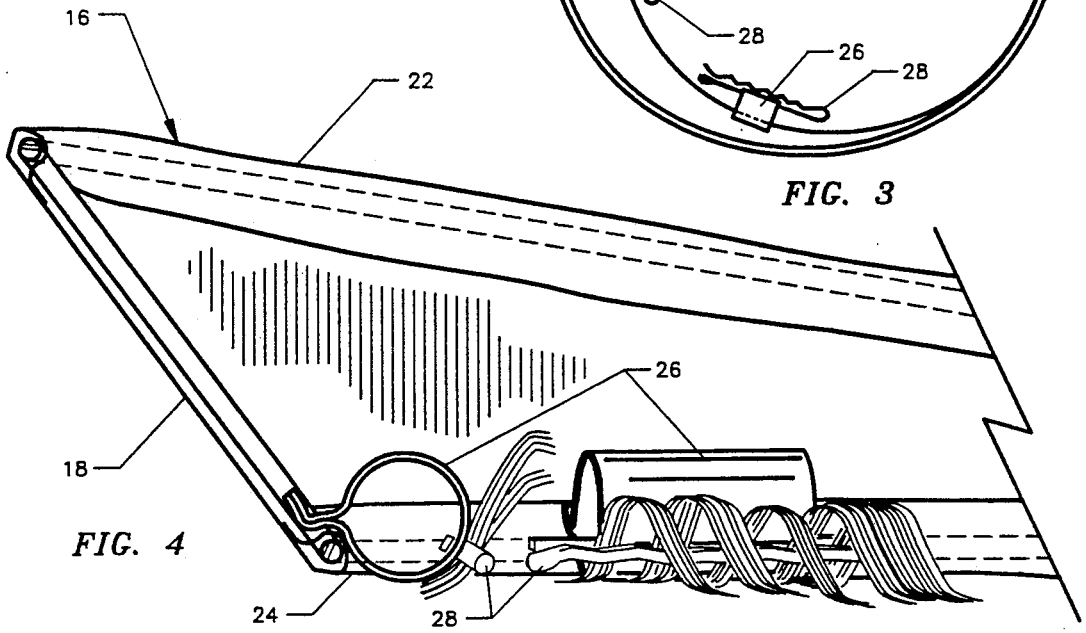
FIG. 4 is a sectional view taken along lines 5—5 of FIG. 1.

The present invention is directed towards the means for attaching veil 10 to the bride's hair. More particularly, the veil includes a headband 16 having an exterior side 18, an interior side 20, a top edge 22 and a bottom edge 24. The securement means includes a plurality of loops 26 attached to the interior side 20 of the headband 16 adjacent the bottom edge 24 thereof. Loops 26 are generally cylindrical, and have a hole or aperture for receiving a bobby pin 28 which secures the headband, and thus the veil, to the bride's head 12. Preferably, the length of the loop is approximately the same length as bobby pin 28. The diameter of the loop need be only sufficient to receive the bobby pin. Preferably, at least one loop is provided at the front and on each lateral side of the headband 16, as best seen in FIG. 4, so as to prevent movement of the headband, and thus the veil or tiara.

Figure 5:
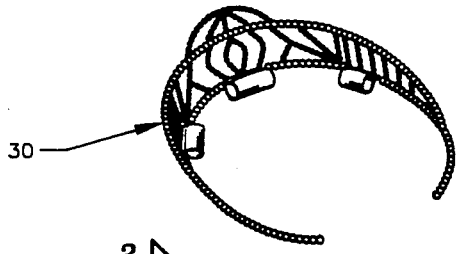
FIG. 5 is a perspective view of a tiara using the securing loops of the present invention.
Figure 2:
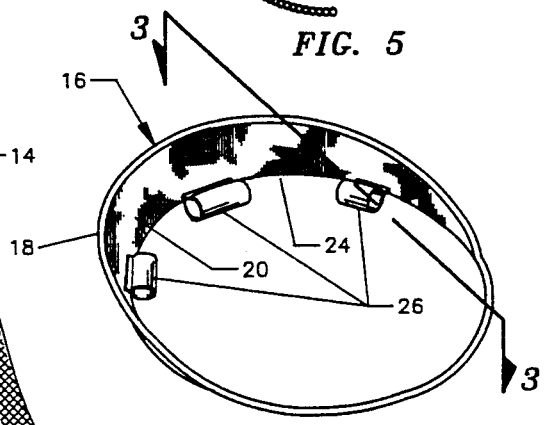
FIG. 2 is a perspective view of the headband without netting attached.
Figure 3:
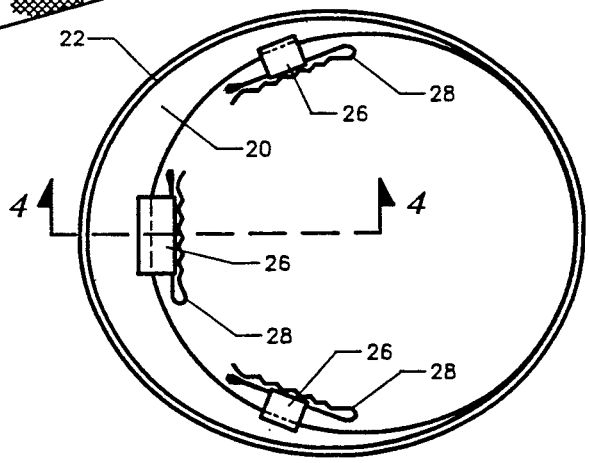
FIG. 3 is a top plan view of the headband.

The headband with securing loops of the present invention can also be used on a tiara 30, as seen in FIG. 5, or other head pieces. It is understood that the headband can extend 360° as shown in the bridal veil 10, or can be open along the back portion, as seen in tiara 30. It is also understood that loops 26 can be sewn to the headband or can be formed integrally therewith.

When the veil or tiara with headband 16 is worn by a bride or other person, the loops 26 are concealed from view due to their attachment on the interior bottom edge of the headband 16. Furthermore, the bobby pins 28 are also hidden from view, since nearly half of the bobby pin is beneath the hair and the other half is hidden within the loop 26. The loops 26 can be colored to match the color of the headband 16, thereby further camouflaging the loops from view. Thus, the entire securement means is virtually invisible when the veil or tiara is in place.

What is claimed is:

1. A bridal veil comprising:

a headband having interior and exterior sides, and top and bottom edges;

netting attached to the headband; and a plurality of loops attached to the interior side of the headband between the top and bottom edges thereof so as to be hidden from external view and each loop being adapted to receive a bobby pin for securing the headband to a person's hair such that the bobby pin is hidden from external view by the headband.

2. The veil of claim 1 wherein the veil has a front, a rear, and opposite lateral sides, the loops being positioned along both lateral sides.

3. The veil of claim 2 wherein another loop is positioned at the front of the veil.

4. The veil of claim 1 wherein each loop comprises an elongated hollow cylinder with a sidewall attached to the headband.

5. The veil of claim 4 wherein the axis of the cylinder is substantially parallel to the adjacent axis of the headband.

6. The veil of claim 4 wherein the length of the cylinder is greater than the diameter of the cylinder.

7. The veil of claim 1 wherein the loop is constructed of a soft, flexible material.

8. The veil of claim 1 wherein the loops are sewn to the headband.

9. The veal of claim 1 wherein the headband is open along the top edge so as to provide access to the loops.

10. An improved tiara having interior and exterior sides and top and bottom edges, the improvement comprising:

securement means on the interior of the tiara between the top and bottom edges so as to be hidden from external view, the securement means having apertures for receiving bobby pins to secure the tiara to a person's hair such that the bobby pins are hidden from external view by the tiara.

11. The tiara of claim 10 further having opposite lateral sides, one securement means being located on each lateral side.

12. The tiara of claim 10 further having a front portion, one securement means being located along the front portion.

13. The tiara of claim 10 wherein the securement means includes a plurality of projections extending inwardly from the tiara, the projections having an aperture for receipt of the bobby pin.

14. The tiara of claim 13 wherein the projections are cylindrical in shape, with the length of the projection exceeding its diameter.

15. The tiara of claim 13 wherein the projection has an axis substantially parallel to the adjacent axis of the tiara.

16. The tiara of claim 10 wherein the securement means is constructed of soft, flexible material.

17. The tiara of claim 10 wherein the securement means is sewn to the tiara.

18. The tiara of claim 10 wherein the securement means are accessible from the top edge.

19. An improved headband for a veil or tiara, a headband having interior and exterior sides and top and bottom edges, the improvement comprising:

securement means on the interior side of the headband so as to be hidden from external view, with apertures for receiving bobby pins to secure the headband to a person's hair such that the bobby pins are hidden from external view by the headband.

20. The headband of claim 19 wherein the securement means is accessible from the top edge.

* * * * *